US007902472B2

(12) United States Patent
Godesa

(10) Patent No.: US 7,902,472 B2
(45) Date of Patent: Mar. 8, 2011

(54) ARRANGEMENT, IN PARTICULAR, FOR ACTIVATING A TRANSPORT PAWL AND CLAMPING DEVICE FOR A SPRING ENERGY STORE OF AN ELECTRIC SWITCH COMPRISING SUCH AN ARRANGEMENT

(75) Inventor: Ludvik Godesa, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 369 days.

(21) Appl. No.: 12/223,780

(22) PCT Filed: Jan. 26, 2007

(86) PCT No.: PCT/EP2007/050793

§ 371 (c)(1),
(2), (4) Date: Aug. 8, 2008

(87) PCT Pub. No.: WO2007/090746

PCT Pub. Date: Aug. 16, 2007

(65) Prior Publication Data

US 2010/0155210 A1 Jun. 24, 2010

(30) Foreign Application Priority Data

Feb. 9, 2006 (DE) ..... 10 2006 006 907

(51) Int. Cl.
*H01H 5/00* (2006.01)

(52) U.S. Cl. ..... 200/400

(58) Field of Classification Search ..... 200/244, 200/400, 238, 401, 318, 327, 320–325; 74/4, 74/150, 111; 254/10.5
See application file for complete search history.

(56) References Cited

U.S. PATENT DOCUMENTS 4,220,936 A 9/1980 Powell
4,742,200 A 5/1988 Marquardt et al.
(Continued)

FOREIGN PATENT DOCUMENTS

DE 4110043 A1 10/1992
DE 4422302 C1 8/1995
DE 10120783 C1 11/2002
EP 0 244 433 11/1986
EP 0224433 A1 6/1987
(Continued)

OTHER PUBLICATIONS

German Office Action PCT/ISA/210, Nov. 3, 2006.

*Primary Examiner* — Edwin A. Leon
(74) *Attorney, Agent, or Firm* — Harness, Dickey & Pierce, P.L.C.

(57) ABSTRACT

An arrangement is disclosed for, in particular, activating a transport pawl including a movable activation device which is secured to a carrying structure and, in a first activation phase, can be moved out of the position of rest into an end position, counter to the force of a restoring spring, and in a second activation phase can be moved out of the end position and back into the position of rest, under the force of the restoring spring. In order to configure the arrangement in such a way that the operator of the activation device is alerted to incompletely executed activation of the activation device, in at least one embodiment a locking mechanism is provided which locks the activation device in the direction of its position of rest during the first activation phase when a first intermediate position is reached, and releases it again when a second intermediate position is reached. The arrangement can be applied in particular in tensioning devices for spring energy stores of electric switches which have a tensioning shaft and a manual drive for turning the tensioning shaft.

17 Claims, 6 Drawing Sheets

U.S. PATENT DOCUMENTS

| | | | | |
|---|---|---|---|---|
| 4,750,375 | A * | 6/1988 | Godesa | 74/2 |
| 6,252,186 | B1 * | 6/2001 | Liebetruth et al. | 200/43.01 |
| 6,777,636 | B2 * | 8/2004 | Ahlert et al. | 200/401 |
| 6,831,240 | B2 * | 12/2004 | Bach et al. | 200/400 |
| 2004/0144629 | A1 | 7/2004 | Dahl et al. | |

FOREIGN PATENT DOCUMENTS

| | | | |
|---|---|---|---|
| EP | 0756749 | B1 | 7/1998 |
| WO | WO 00/58984 | | 10/2000 |
| WO | WO 0058984 | A1 | 10/2000 |

* cited by examiner

ARRANGEMENT, IN PARTICULAR, FOR ACTIVATING A TRANSPORT PAWL AND CLAMPING DEVICE FOR A SPRING ENERGY STORE OF AN ELECTRIC SWITCH COMPRISING SUCH AN ARRANGEMENT

This application is the national phase under 35 U.S.C. §371 of PCT International Application No. PCT/EP2007/050793 which has an International filing date of Jan. 26, 2007, which designated the United States of America and which claims priority on German application No. 10 2006 006 907.2 filed Feb. 9, 2006, the entire contents of each of which are hereby incorporated herein by reference.

FIELD

At least one embodiment of the invention generally relates to an arrangement. In at least one particular example embodiment, it relates to an arrangement for actuating a transport pawl with a movable actuating device, which is held on a supporting framework and, in a first actuation phase, can be moved over out of a rest position into an end position counter to the force of a restoring spring and, in a second actuation phase, can be moved over out of the end position back into the rest position under the force of the restoring spring.

At least one embodiment of the invention furthermore generally relates to a tensioning apparatus for a spring-energy store of an electrical switch with such an arrangement.

BACKGROUND

An arrangement is known, for example, from the document EP 0 756 749 B1. In this known arrangement for a circuit breaker, a tension lever is provided as the actuating device, on which tension lever a transport pawl is articulated. The transport pawl is used for stepwise rotation of a ratchet wheel arranged fixedly on a tensioning shaft. An additional cutout is provided in one of the teeth of the ratchet wheel. This additional cutout ensures that, given a predetermined tensioning excursion of the tension lever, the tensioning shaft cannot be rotated back by an angle corresponding to the full pitch of the teeth of the ratchet wheel if the tensioning excursion is not completely performed by the manual lever. As a result, the tensioning shaft is held in a position in which a switching mechanism already effectively latches a tensioned spring-energy store of the circuit breaker.

It is known from the document DE 101 20 783 C1 that a display element can be coupled to such a switching mechanism for a spring-energy store. This coupling can take place in such a way that, as early as shortly before the effective latching of the tensioned spring-energy store, it is indicated that the spring-energy store is completely tensioned. In this case, there is the risk that, in the case of an incompletely performed tensioning excursion, the display element indicates a completely tensioned spring-energy store and therefore switch-on readiness, but the circuit breaker cannot yet be switched on.

SUMMARY

At least one embodiment of the invention includes an arrangement configured in such a way that the operator of the actuating device is made aware of incomplete actuation of the actuating device.

In accordance with at least one embodiment of the invention, an inhibiting mechanism, blocks the actuating device in the direction of its rest position during the first actuation phase when a first intermediate position is reached and releases it again when a second intermediate position is reached.

An example configuration of at least one embodiment of the invention provides that a guide face of the actuating device and a pawl lever are used as the inhibiting mechanism,

- the guide face having a recessed first section and a projecting second section,
- the pawl lever being capable of pivoting about a stationary pivot spindle and being supported on a dead-center spring, and
- the pawl lever having an arm, which, during the first actuation phase, engages in the movement path of the recessed section when the first intermediate position of the actuating device is reached, which arm, having been pivoted out of the movement path of the recessed section beyond the dead-center point of the dead-center spring by sliding on the projecting section when the second intermediate position of the actuating device is reached, is supported on a first stop, and which arm, having been pivoted again beyond the dead-center point of the dead-center spring by sliding on a second stop at the end of the second actuation phase, is supported in resilient fashion on the guide face.

In a further example embodiment configuration it is provided that the actuating device is a tension lever, which is capable of pivoting about a stationary pivot bearing.

The novel arrangement of at least one embodiment can be used in particular in tensioning apparatuses for spring-energy stores of electrical switches which have a tensioning shaft and a manual drive for rotating the tensioning shaft and in which the manual drive has a ratchet wheel, which is arranged fixedly on the tensioning shaft, and a transport pawl, which is prestressed in resilient fashion against the ratchet wheel for the purpose of rotating the ratchet wheel.

BRIEF DESCRIPTION OF THE DRAWINGS

Example embodiments of the present invention will now be explained in more detail with reference to the attached drawings, in which.

DETAILED DESCRIPTION OF THE EXAMPLE EMBODIMENTS

Figure 1:
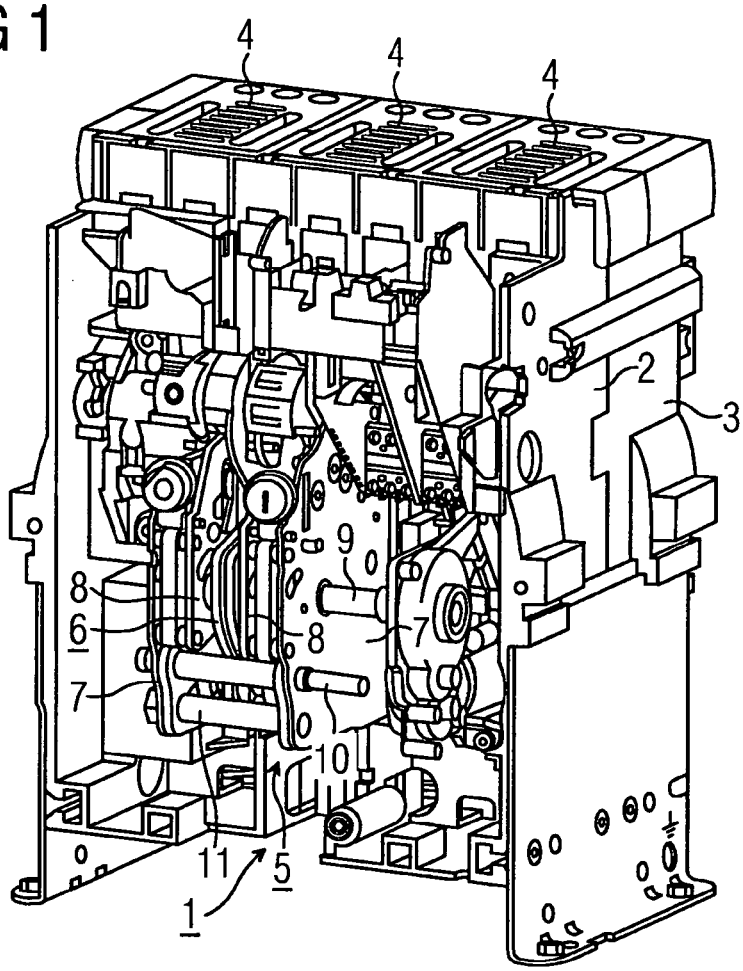
FIG. 1 shows a low-voltage circuit breaker with a drive mechanism, which has a tensioning shaft for tensioning a spring-energy store.
Figure 3:
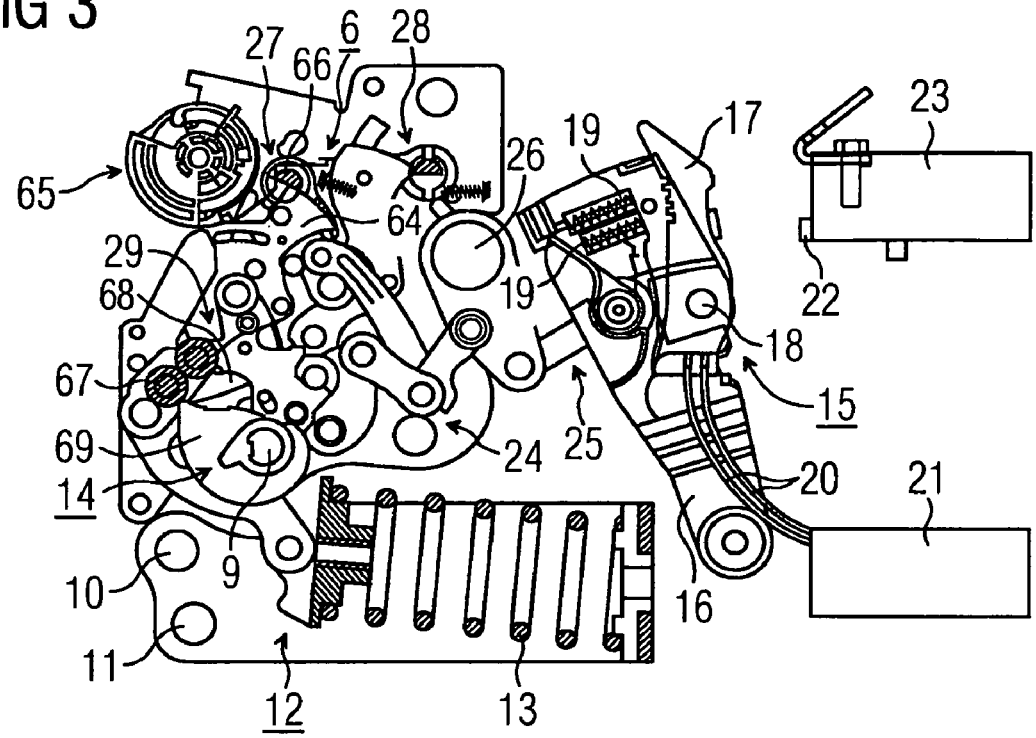
FIG. 3 shows a sectional illustration of the low-voltage circuit breaker with a movable contact, which is coupled to the spring-energy store, and with a stationary contact.

The low-voltage circuit breaker 1 shown in FIG. 1 has a housing which comprises two half shells 2, 3 and is used for accommodating a contact arrangement, as is described in more detail in FIG. 3. Furthermore, the low-voltage circuit breaker 1 has a plurality of arc-quenching chambers 4 and a drive mechanism 6, which is supported on a supporting framework 5 and can be covered by a covering hood (not illustrated) to be fastened on the front half shell 2 of the housing.

The supporting framework 5, which comprises a plurality of supporting plates 7, 8 and is likewise fastened on the front half shell 2 of the housing, has a tensioning shaft 9 and a plurality of supporting and spacer bolts passing through it. The supporting bolts 10, 11 are in this case used for fastening a holder 12 (shown in more detail in FIG. 3) of a spring-energy store 13 of the drive mechanism 6.

Figure 2:
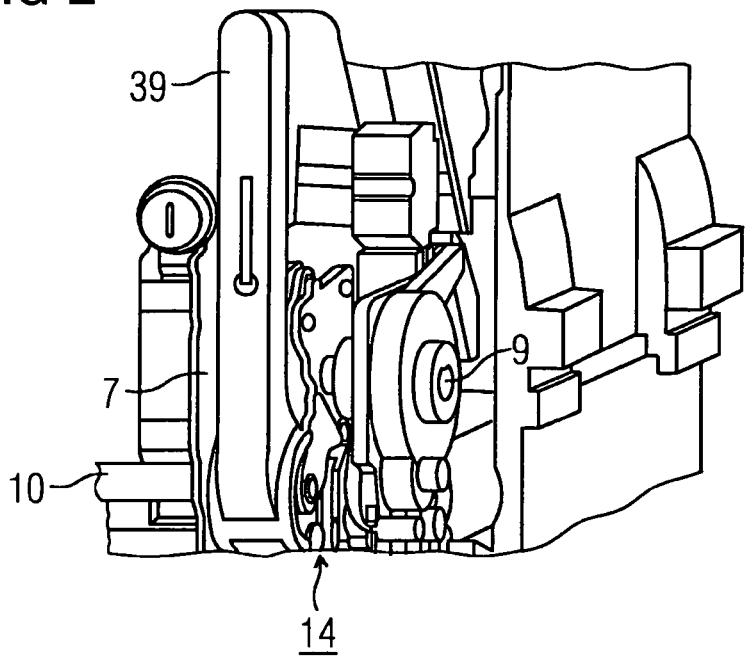
FIG. 2 shows a detail of the low-voltage circuit breaker with an arrangement for actuating a transport pawl, which is arranged fixedly on the tensioning shaft.

As shown in FIG. 2, a tensioning, apparatus 14 for the spring-energy store 13 (cf. FIG. 3) is arranged on the tensioning shaft 9 and one of the supporting bolts 10 on one of the supporting plates 7.

As shown in FIG. 3, the drive mechanism 6 is used for actuating a movable contact 15, which has a plurality of contact levers 17 (although in the figure only one contact lever is shown), which are supported in a pivotable contact carrier 16 and are arranged parallel to one another. The contact levers 17 are fitted pivotably in a known manner by way of a hinged bolt 18 in the contact carrier 16 and are prestressed by in each case two contact force springs 19. Flexible conductors 20 are used for connecting the contact levers 17 to a lower terminal bar 21. The stationary contact 22, which is associated with the movable contact 15 of the contact arrangement, is connected to an upper terminal bar 23. The drive mechanism 6 has a drive train comprising a first coupling rod assembly 24 and a second coupling rod assembly 25 as well as a switching shaft 26 for the movable contact 15. Furthermore, the drive mechanism 6 includes the spring-energy store 13, by which the energy for switching the switch on and off, i.e. for closing and opening the contacts 15, 22, can be stored, a switching mechanism 27 for latching the spring-energy store 13 in its tensioned state and a switching mechanism 28 for latching the drive train when the contacts 15, 22 are closed and the tensioning apparatus 14 for tensioning the spring-energy store 13.

The way in which the switching mechanism for latching the spring-energy store functions has already been described in detail in the document DE 101 20 783 C1, with the result that no more detail is given at this juncture. However, it is noted that the tensioning apparatus 14 is coupled to the spring-energy store 13 during a tensioning phase of the spring-energy store 13 via a lever system 29 and is decoupled from the lever system 29 during a latching phase of the spring-energy store 13.

A part of the tensioning apparatus is the tensioning shaft 9, which can be rotated by way of a manual drive 31 (illustrated in more detail in FIGS. 4 to 11).

Figure 4:
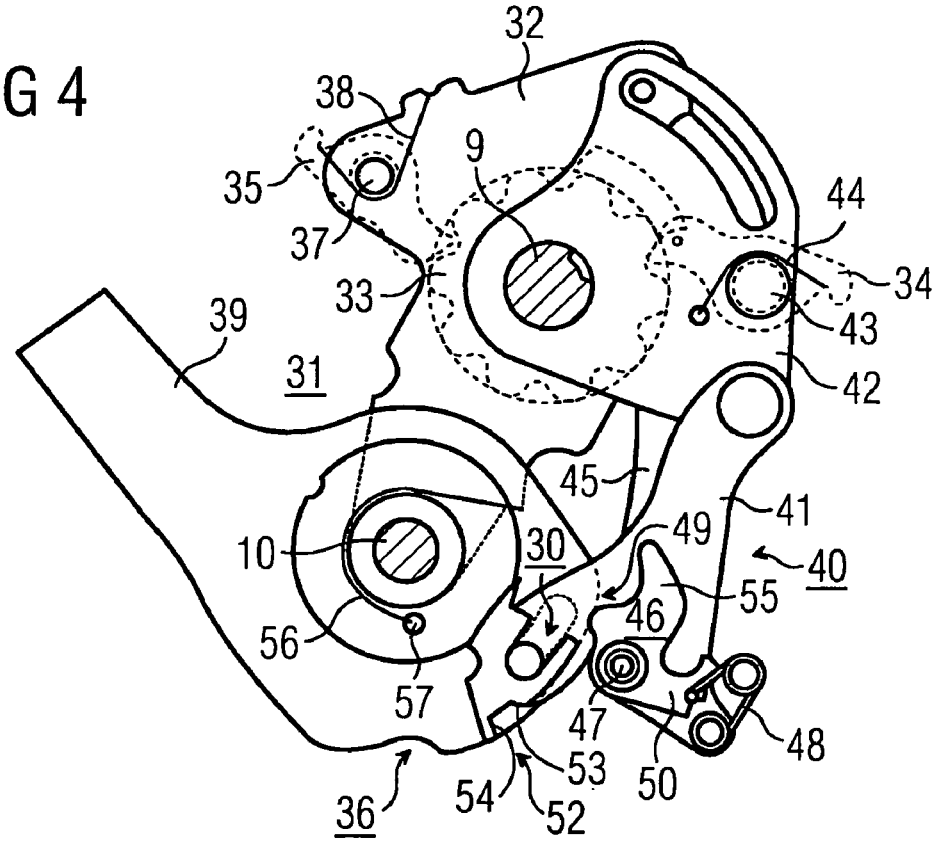
FIGS. 4 to 11 show the arrangement for actuating the transport pawl shown in FIG. 2 in various phases of its movement sequence.

As shown in FIG. 4, the manual drive 31 comprises two supporting plates 32 (only one is shown in the figures), a ratchet wheel 33, a transport pawl 34, a detent pawl 35 and an arrangement 36, which is coupled to the transport pawl, for actuating the transport pawl.

The supporting plates 32 of the manual drive are held fixed in position on the supporting framework by way of the tensioning shaft 9 and the supporting bolt 10. The ratchet wheel 33 is arranged fixedly on the tensioning shaft 9. The detent pawl 35 is held pivotably on the supporting plates 32 of the manual drive 31 by way of a first spacer bolt 37 and is prestressed in resilient fashion against the ratchet wheel 33 by way of a first contact-pressure spring 38.

The arrangement 36 for actuating the transport pawl 33 comprises an actuating device 39 in the form of a tension lever and a coupling train 40 for coupling the tension lever to the transport pawl. The stationary pivot bearing for the tension lever is in this case formed by the supporting bolt 10.

The coupling train 40 in this case has a first lever 41, which is articulated on the tension lever by way of a slot/bolt joint 30, and two second levers 42 (only one is shown in the figures), which are capable of pivoting about the rotary spindle of the ratchet wheel, the transport pawl 34 being held pivotably on the second levers 42 by way of a second spacer bolt 43 and being prestressed likewise in resilient fashion against the ratchet wheel 33 by way of a second contact-pressure spring 44.

A supporting lever 45 is fastened on the supporting plates 32 of the manual drive 31, and a pawl lever 46 is articulated on the supporting lever 45 in a manner in which it is capable of pivoting about a stationary pivot spindle 47 in the form of a pin and is prestressed, by way of a dead-center spring 48, in resilient fashion against a guide face 49 of the tension lever. The dead-center spring is in this case supported on a first arm 50 of the pawl lever 46 in such a way that the spring force of the dead-center spring 48 first acts on the pawl lever in the counterclockwise direction.

The pawl lever 46 and the guide face 49 together form an inhibiting mechanism 51 for the tension lever.

The guide face 49 has a cutout 52, whose inner sides form a recessed first section 53 and a projecting second section 54.

The pawl lever 46, which is capable of pivoting about the stationary pivot spindle 47 and is supported on the dead-center spring 48, has a second arm 55, which interacts with the guide face.

As shown in FIGS. 4 to 11, the actuating device 39 in the form of the tension lever is capable of being moved over, during a first tensioning phase (tensioning excursion shown in FIGS. 4 to 8), counter to the force of two restoring springs 56 out of a rest position (cf. FIG. 2) into an end position (cf. FIG. 8) and, in a second actuation phase (return excursion shown in FIGS. 9 to 11), under the force of the restoring springs 56 out of the end position back into the rest position. One free end of the restoring springs 56 in this case engages in a bore 57 of the actuating device 39, while the other free end is supported on in each case one of the supporting plates 32.

FIGS. 4 to 8 show the movement sequence of the arrangement for actuating the transport pawl during the first actuation phase, i.e. during the tensioning excursion of the actuating device.

Figure 5:
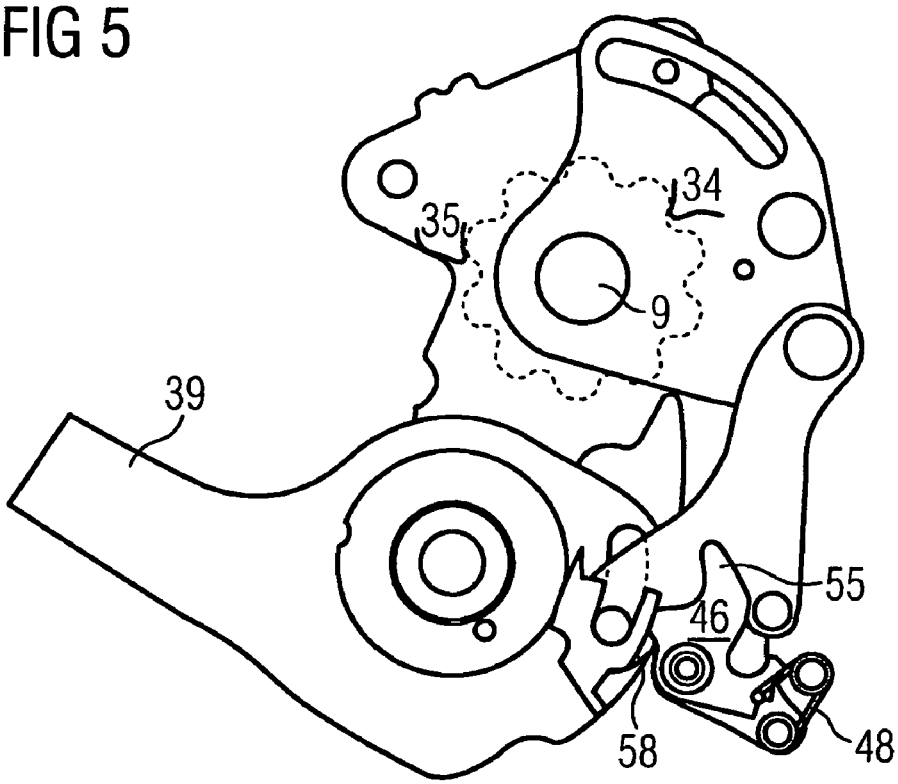

As shown in FIGS. 4 and 5, the second arm 55 of the pawl lever first, under the force of the dead-center spring 48, bears against a curved section 58 of the guide face. In this phase of the movement sequence, the transport pawl 34 drives the ratchet wheel 33 and therefore rotates the tensioning shaft 9 in the counterclockwise direction. In this case, the spring-energy store 13 is tensioned to, a certain extent, as is described in detail in the document DE 101 20 783 C1.

Figure 6:
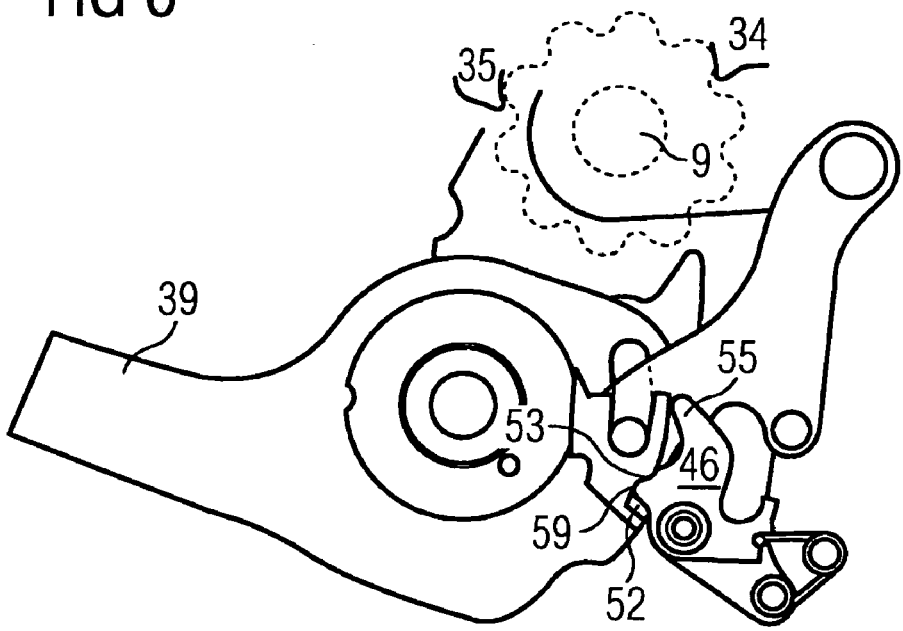

FIG. 6 shows the actuating device 39 in a first intermediate position; when this first intermediate position is reached, a projecting edge 59 of the second arm 55 of the pawl lever engages in the cutout 52 and therefore in the movement path of the recessed first section 53. If in this phase the tensioning excursion is interrupted, it is no longer possible for the actuating device 39 to rotate back in the direction of the rest position since the pawl lever blocks the actuating device in the clockwise direction by engaging in the cutout 52.

Figure 7:
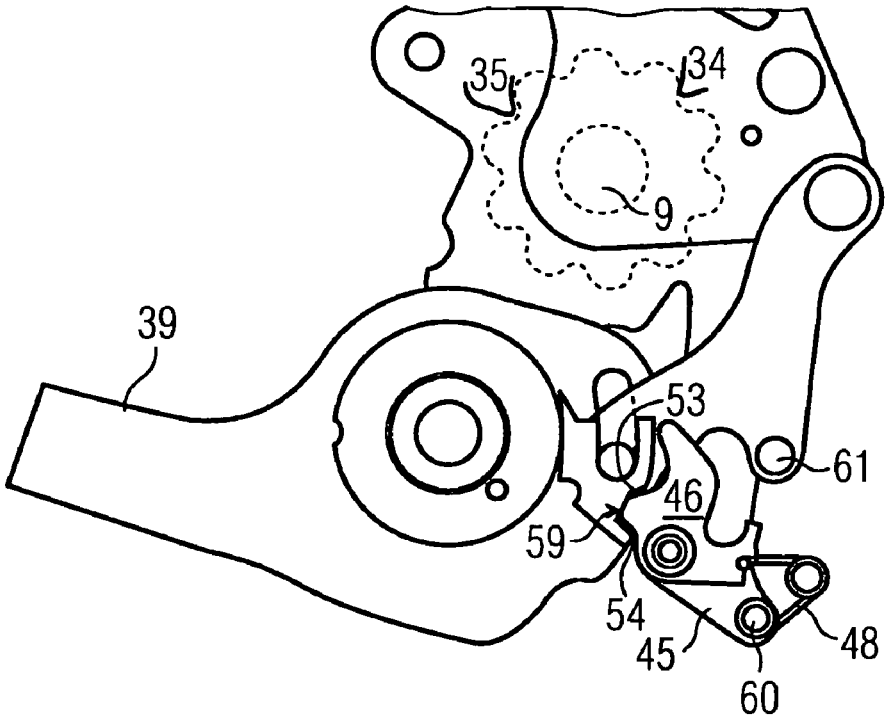
Figure 8:
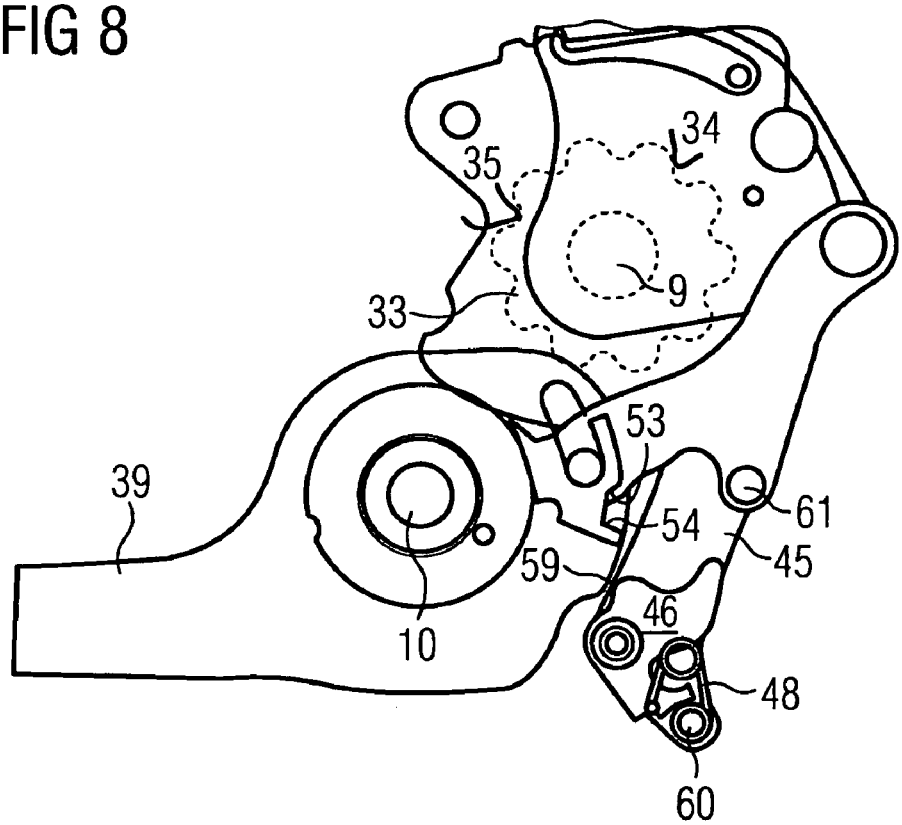

As shown in FIGS. 7 and 8, the projecting edge 59 of the pawl lever continues to slide along the projecting section of the guide face out of the movement path of the recessed section 53.

In a second intermediate position of the actuating device 39, the pawl lever then assumes a position in which the dead-center point of the dead-center spring 48 is exceeded and therefore the spring force of the dead-center spring acts on the pawl lever in the opposite direction. The pawl lever, as shown in FIG. 8, comes to bear against a first stop 60. This first stop 60 is formed by a pin, which is fastened on the supporting lever 45 and which at the same time forms the abutment for the dead-center spring 48.

When the end position of the actuating device 39 shown in FIG. 8 is reached, the detent pawl 35 engages in a cutout between two teeth of the ratchet wheel and therefore blocks the ratchet wheel in the clockwise direction.

Figure 9:
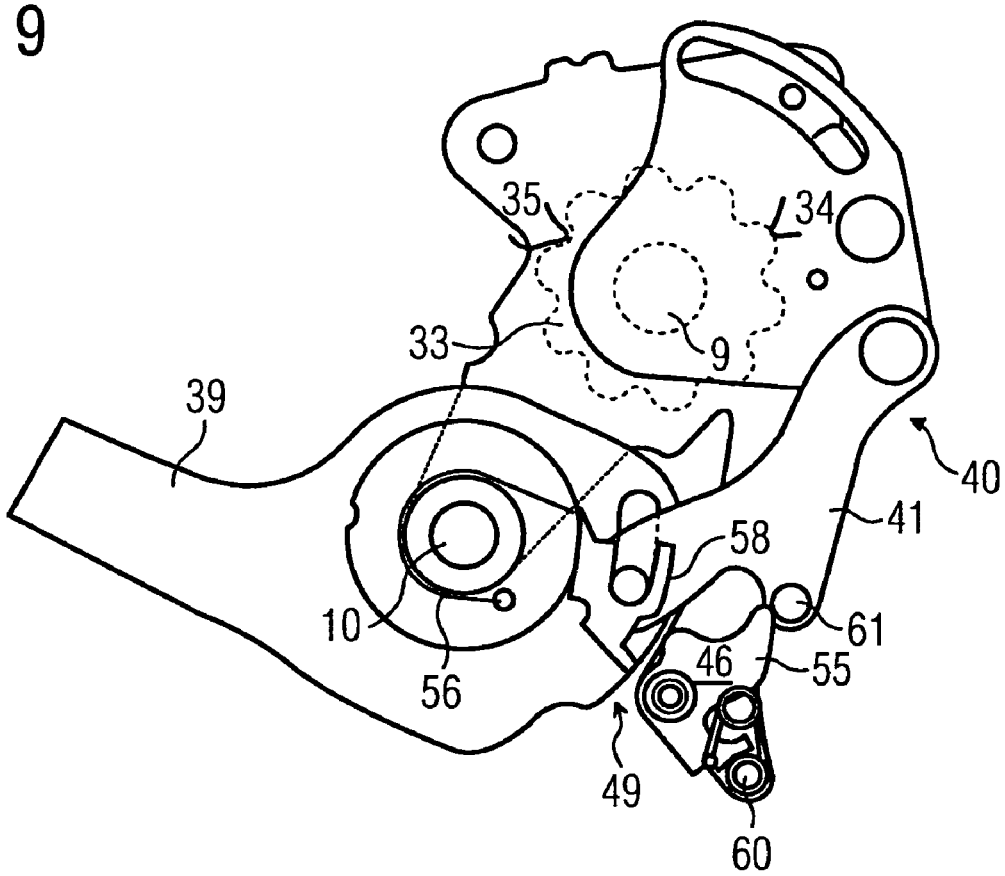
Figure 10:
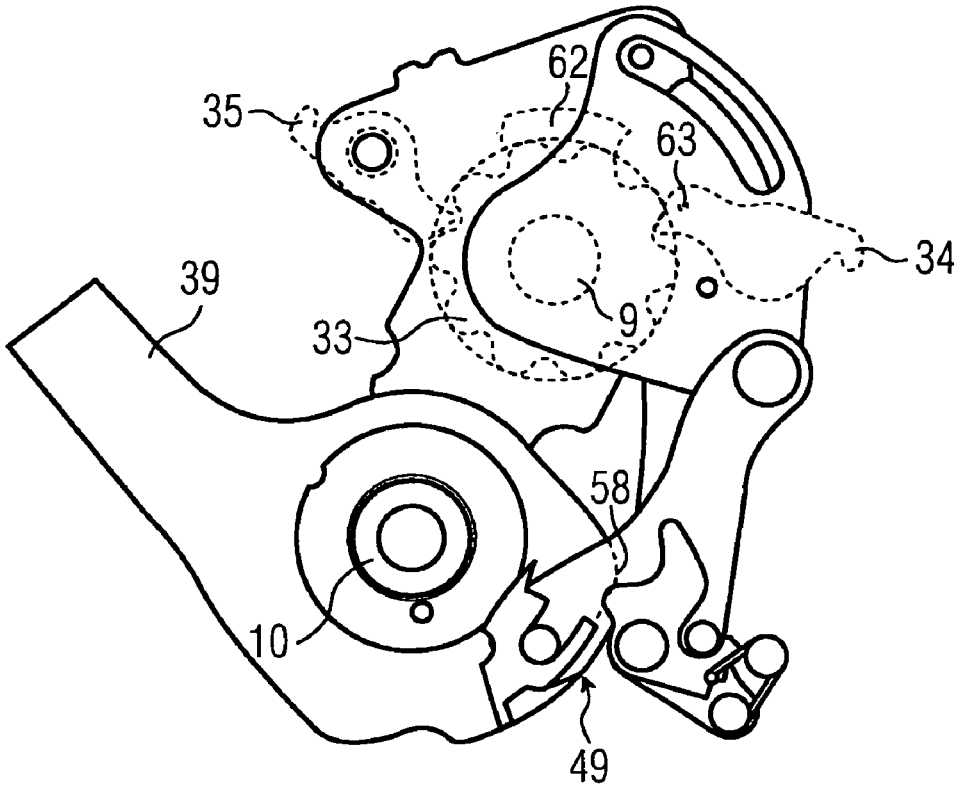
Figure 11:
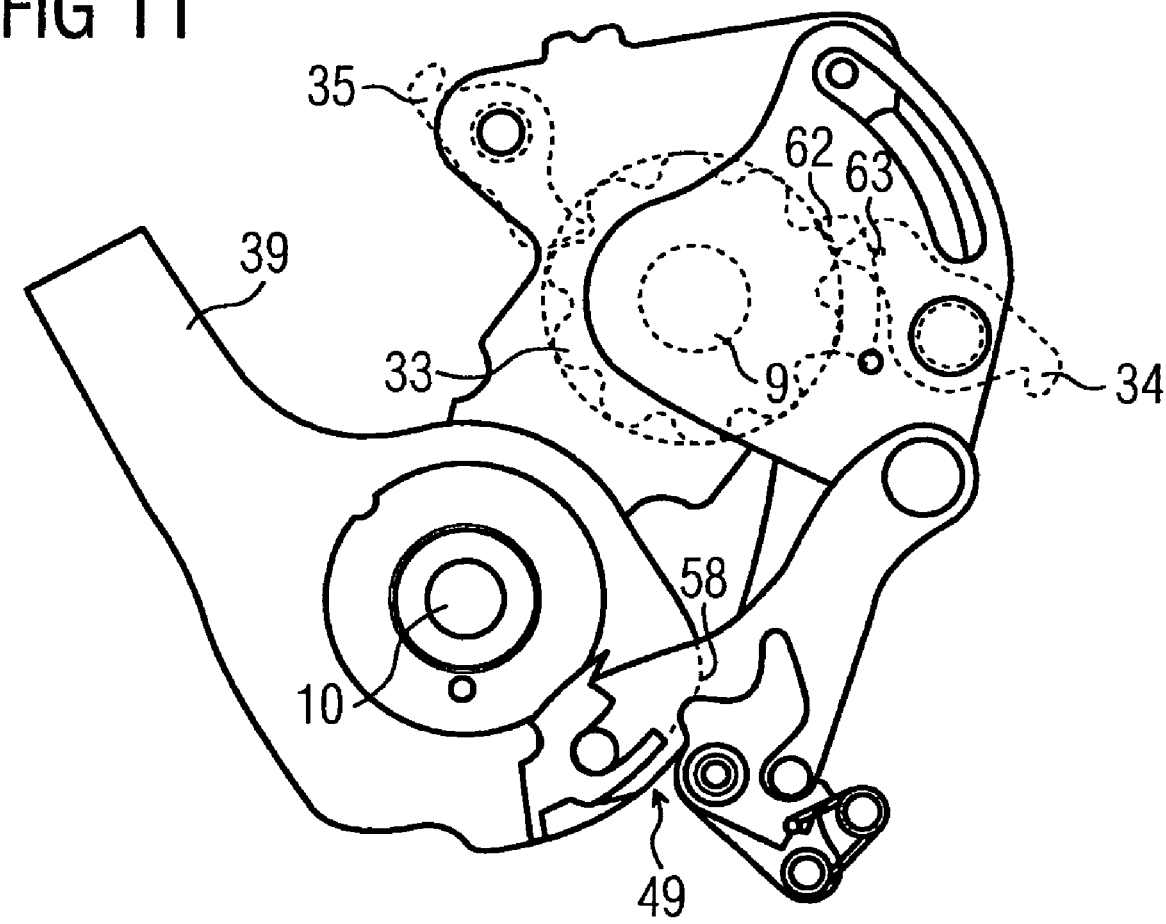

In the second actuation phase shown in FIGS. 9 to 11, in which the actuating device 39 is moved over out of the end position back into the rest position under the force of the restoring springs 56, the second arm 55 of the pawl lever slides on a second stop 61 protruding into its movement path. This second stop 61 is formed by a pin, which is fastened on the first lever 41 of the coupling train 40.

By way of the interaction with the second stop 61, the pawl lever 46 again pivots beyond the dead-center point of the dead-center spring and again comes to bear against the curved section 58 of the guide face 49.

At the same time as this, as shown in FIG. 9, the transport pawl 34 in the second actuation phase slides over the next (in the clockwise direction) tooth of the ratchet wheel 33 which is blocked by the detent pawl 35 and, as shown in FIG. 10, engages in the next (in the clockwise direction) cutout of the ratchet wheel shortly before the rest position of the actuating device is reached. The arrangement for actuating the transport pawl is therefore ready for the next tensioning excursion.

Eight completely performed tensioning excursions are required for the complete tensioning and latching of the spring-energy store 13.

In order to ensure that the transport pawl and therefore the tensioning shaft 9 is not rotated still further by further tensioning excursions, at the end of the eighth tensioning excursion the engagement of the transport pawl in the next (in the clockwise direction) cutout is prevented. For this purpose, as shown in FIG. 11, a cam 62 is formed on the ratchet wheel 33, which has in total ten teeth and therefore also ten cutouts, and a journal 63 of the transport pawl 34 is associated with said cam. This cam 62 extends over two teeth and protrudes in the radial direction of the ratchet wheel beyond the outer edge of the teeth in such a way that the transport pawl 34 on the eighth return excursion, i.e. in the second actuation phase, pivots out of the movement path of the teeth and cannot engage in the cutout between these two teeth which are covered by the cam 62.

As shown in FIG. 3, a display element 65 is coupled to a main pawl 64 of the switching mechanisms 27 which has already been described in detail in the document DE 101 20 783 C1, and this display element 65 signals the state of the spring-energy store 13. This display element 65 signals as early as shortly before the end of the eighth tensioning excursion that the spring-energy store 13 is completely tensioned. In this phase of the eighth tensioning excursion, the main pawl 64 of the switching mechanism 27 has already experienced an excessive excursion behind a semi-shaft 66 acting as a stop, but a scanning roller 67 of a roller lever 68 of the lever system 29 has not yet become decoupled from the peripheral edge of a cam disk 69, with the result that the spring-energy store 13 cannot yet be latched in its tensioned position. The circuit breaker 1 is therefore not yet ready to switch on.

In order to prevent the eighth tensioning excursion from being interrupted before the end by the operator owing to the display of the display element, the first intermediate position of the actuating device 39 in the form of the tension lever is selected in such a way that it is reached on the eighth tensioning excursion before the display element 65 signals that the spring-energy store 13 is completely tensioned.

If the operator of the tension lever interrupts the tensioning excursion once the first intermediate position has been reached, the tension lever is blocked against rotating back into its rest position. In this case, the tension lever staying in position indicates to the operator that it has not completely performed the tensioning excursion.

The second intermediate position is selected in such a way that the tension lever is only released again when the roller lever 68 is decoupled from the peripheral edge of the cam disk 69 and therefore the tensioned spring-energy store 13 is actually latched.

It is furthermore known from the document DE 101 20 783 C1 that the roller lever 68 is coupled to the cam disk 69 again once the switching mechanism 27 has been released and that the cam disk 69 completes its full rotation through 360° with this coupling and reaches its initial position (illustrated in FIG. 4) again. The tensioning shaft 9, on which the cam disk 69 is arranged in a manner in which it is fixed against rotation, and the ratchet wheel 33 therefore also assume their initial position (illustrated in FIG. 4) again.

Blocking of the actuating device 39 in the form of the tension lever advantageously takes place not only on the eighth (last) tensioning excursion, but also on every other tensioning excursion, with the result that the operator of the actuating device 39 is prevented from performing the tensioning excursions incompletely.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE SYMBOLS

1 Low-voltage circuit breaker
2, 3 Half shells of the housing of the low-voltage circuit breaker
4 Arc-quenching chambers
5 Supporting framework
6 Drive mechanism
7, 8 Supporting plates of the supporting framework
9 Tensioning shaft
10, 11 Supporting bolts
12 Holder of a spring-energy store
13 Spring-energy store
14 Tensioning apparatus for the spring-energy store 13
15 Movable contact
16 Pivotable contact carrier
17 Contact lever
18 Hinged bolt
19 Contact-force springs
20 Flexible conductors
21 Lower terminal bar
22 Stationary contact
23 Upper terminal bar
24 First coupling rod assembly of the drive mechanism
25 Second coupling rod assembly of the drive mechanism
26 Switching shaft
27 Switching mechanism for latching the spring-energy store 13 in its tensioned state
28 Switching mechanism of latching the drive train when the contacts 15, 22 are closed
29 Lever system
30 Slot/bolt joint
31 Manual drive for the tensioning shaft
32 Supporting plates
33 Ratchet wheel
34 Transport pawl

35 Detent pawl
36 Arrangement for actuating the transport pawl
37 First spacer bolt
38 First contact-pressure spring
39 Actuating device
40 Coupling train
41 First lever of the coupling train
42 Second lever of the coupling train
43 Second spacer bolt
44 Second contact-pressure spring
45 Supporting lever
46 Pawl lever
47 Stationary pivot spindle
48 Dead-center spring
49 Guide face
50 First arm of the pawl lever
51 Inhibiting mechanism
52 Cutout
53 Recessed first section of the cutout
54 Projecting second section of the cutout
55 Second arm of the pawl lever
56 Restoring spring
57 Bore of the actuating device
58 Curved section of the guide face
59 Projecting edge of the pawl lever
60 First stop for the pawl lever
61 Second stop for the pawl lever
62 Cam of the ratchet wheel
63 Journal of the transport pawl
64 Main pawl
65 Display element
66 Stop
67 Scanning roller
68 Roller lever
69 Cam disk

The invention claimed is:

1. An arrangement, comprising:

a movable actuating device, on a supporting framework, moveable, in a first actuation phase, out of a rest position into an end position counter to a force of a restoring spring and moveable, in a second actuation phase, out of the end position back into the rest position under the force of the restoring spring; and an inhibiting mechanism to block the actuating device in the direction of its rest position during the first actuation phase when a first intermediate position is reached and to release the actuating device when a second intermediate position is reached.

2. The arrangement as claimed in claim 1, wherein a guide face of the actuating device and a pawl lever are used as the inhibiting mechanism.

3. The arrangement as claimed in claim 1, wherein the actuating device is a tension lever, which is capable of pivoting about a stationary pivot bearing.

4. A tensioning apparatus for a spring-energy store of an electrical switch, comprising:

a tensioning shaft; and a manual drive to rotate the tensioning shaft, the manual drive including a ratchet wheel arranged fixedly on the tensioning shaft, a transport pawl prestressed in resilient fashion against the ratchet wheel to rotate the ratchet wheel, and an arrangement coupled to the transport pawl, to actuate the transport pawl, the arrangement to actuate the transport pawl being as the arrangement claimed in claim 1.

5. The tensioning apparatus as claimed in claim 3, wherein a pivot bearing of the tension lever is spaced apart from a rotary spindle of the tensioning shaft.

6. The tensioning apparatus as claimed in claim 5, wherein, in order to couple the tension lever to the transport pawl, a coupling train is provided which comprises a first lever articulated on the tension lever, and a second lever capable of pivoting about the rotary spindle of the ratchet wheel and bearing the transport pawl.

7. The tensioning apparatus as claimed in claim 6, wherein a first stop is arranged fixed in position in relation to the supporting framework, and a second stop is arranged on the first lever of the coupling train.

8. A low-voltage circuit breaker comprising a spring-energy store and a tensioning apparatus for the spring-energy store, designed as claimed in claim 4.

9. The arrangement as claimed in claim 1, wherein the arrangement is for actuating a transport pawl.

10. The arrangement as claimed in claim 2, wherein the guide face includes a recessed first section and a projecting second section, the pawl lever being capable of pivoting about a stationary pivot spindle and being supported on a dead-center spring, and the pawl lever having an arm, which, during the first actuation phase, engages in a movement path of a recessed section of the guide face when the first intermediate position of the actuating device is reached, which arm, having been pivoted out of the movement path of the recessed section beyond the dead-center point of the dead-center spring by sliding on a projecting section of the guide face when the second intermediate position of the actuating device is reached, is supported on a first stop, and wherein the arm, having been pivoted again beyond the dead-center point of the dead-center spring by sliding on a second stop at the end of the second actuation phase, is supported in resilient fashion on the guide face.

11. The arrangement as claimed in claim 2, wherein the actuating device is a tension lever, which is capable of pivoting about a stationary pivot bearing.

12. The arrangement as claimed in claim 10, wherein the actuating device is a tension lever, which is capable of pivoting about a stationary pivot bearing.

13. A low-voltage circuit breaker comprising a spring-energy store and a tensioning apparatus for the spring-energy store, designed as claimed in claim 5.

14. A low-voltage circuit breaker comprising a spring-energy store and a tensioning apparatus for the spring-energy store, designed as claimed in claim 6.

15. A low-voltage circuit breaker comprising a spring-energy store and a tensioning apparatus for the spring-energy store, designed as claimed in claim 7.

16. A tensioning apparatus for a spring-energy store of an electrical switch, comprising:

a tensioning shaft; and a manual drive to rotate the tensioning shaft, the manual drive including a ratchet wheel arranged fixedly on the tensioning shaft, a transport pawl prestressed in resilient fashion against the ratchet wheel to rotate the ratchet wheel, and an arrangement coupled to the transport pawl, to actuate the transport pawl, the arrangement to actuate the transport pawl being as the arrangement claimed in claim 2.

17. A tensioning apparatus for a spring-energy store of an electrical switch, comprising:

a tensioning shaft; and a manual drive to rotate the tensioning shaft, the manual drive including a ratchet wheel arranged fixedly on the tensioning shaft, a transport pawl prestressed in resilient fashion against the ratchet wheel to rotate the ratchet wheel, and an arrangement coupled to the transport pawl, to actuate the transport pawl, the arrangement to actuate the transport pawl being as the arrangement claimed in claim 3.

* * * * *